US009604231B1

(12) United States Patent
Wang

(10) Patent No.: US 9,604,231 B1
(45) Date of Patent: Mar. 28, 2017

(54) IMPINGEMENT SPRINKLER

(71) Applicant: Cheng-An Wang, Lu Kang Town (TW)

(72) Inventor: Cheng-An Wang, Lu Kang Town (TW)

( * ) Notice: Subject to any disclaimer, the term of this patent is extended or adjusted under 35 U.S.C. 154(b) by 0 days.

(21) Appl. No.: 14/987,181

(22) Filed: Jan. 4, 2016

(51) Int. Cl.
*B05B 3/02* (2006.01)
*B05B 3/04* (2006.01)
*B05B 15/06* (2006.01)

(52) U.S. Cl.
CPC ..... *B05B 3/021* (2013.01); *B05B 3/0481* (2013.01); *B05B 15/066* (2013.01)

(58) Field of Classification Search
CPC ..... B05B 3/021; B05B 3/0472; B05B 3/0477; B05B 3/0481; B05B 15/065; B05B 15/066
See application file for complete search history.

(56) References Cited

U.S. PATENT DOCUMENTS 2,309,782 A * 2/1943 Orr ..... B05B 3/0477 239/233
2,928,608 A * 3/1960 Royer ..... B05B 3/0477 239/230
3,033,469 A * 5/1962 Green ..... B05B 3/0477 239/230
3,051,396 A * 8/1962 McElhenie ..... B05B 3/0477 239/230
3,581,994 A * 6/1971 Heiberger ..... B05B 3/0481 239/230
3,831,853 A * 8/1974 Drori ..... B05B 3/0481 239/230
4,164,324 A * 8/1979 Bruninga ..... B05B 3/0472 239/230
4,182,494 A * 1/1980 Wichman ..... B05B 15/10 239/230
4,497,441 A * 2/1985 Chow ..... B05B 3/0477 239/230
4,907,742 A * 3/1990 Whitehead ..... B05B 3/0481 239/230
4,978,070 A * 12/1990 Chow ..... B05B 3/0472 239/230
2012/0241539 A1* 9/2012 Wang ..... B05B 1/3026 239/233
2014/0042244 A1* 2/2014 Huang ..... B05B 3/0477 239/230

* cited by examiner

*Primary Examiner* — Darren W Gorman
(74) *Attorney, Agent, or Firm* — Egbert Law Offices, PLLC

(57) ABSTRACT

An impingement sprinkler includes a main frame and a tubular structure rotatably mounted onto a lower portion of the main frame. A sprinkling device is laterally mounted onto the main frame and an impinging device is pivotally mounted on the sprinkling device. The impinging device continually impinges the sprinkling device for intermittently rotating the main frame relative to the tubular structure when the sprinkling device continually sprinkles. A reversing device is mounted onto the sprinkling device for controlling the irrigating area of the impingement sprinkler. A trigger is connected to the reversing device and two limit rods horizontally pivotally mounted on the tubular structure, wherein a poke rod is pivotally connected to the trigger and absolutely limited between two limit rods so as to enable steering of the impingement sprinkler.

1 Claim, 9 Drawing Sheets

IMPINGEMENT SPRINKLER

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to an impingement sprinkler, and more particularly to an innovative one which is used to absolutely limit the poke rod between two limit rods so as to enable steering of the impingement sprinkler.

2. Description of Related Art Including Information Disclosed Under 37 CFR 1.97 and 37 CFR 1.98

Impingement sprinklers are extensively used for gardening irrigation and spraying, since circulating or reciprocating water sprinkling of the impingement sprinklers can be realized in an annular zone. In order to further improve its practicability, a tilting impingement sprinkler has been developed, allowing adjusting the outlet angle by tilting upwards or downwards (i.e. when tilting upwards, the parabolic sprinkling distance is bigger, or otherwise smaller) so as to meet the users' diversified demands. The present invention is intended to improve the steering structure of this tilting impingement sprinkler.

A conventional impingement sprinkler in accordance with the prior art shown in FIGS. 7 and 8 comprises a main frame 90 and a tubular structure 91 rotatably mounted onto a lower portion of the main frame 90, wherein the tubular structure 91 is adapted to be securely connected to an upright pipe (not shown). A sprinkling device 92 is laterally mounted onto the main frame 90 and an impinging device 93 is pivotally mounted on the sprinkling device 92. The impinging device 93 continually impinges the sprinkling device 92 for intermittently rotating the main frame 90 relative to the tubular structure 91 and forming an annular irrigating area when the sprinkling device 92 continually sprinkles and the sprinkled water continually forces on the impinging device 93.

A reversing device 94 is mounted onto the sprinkling device 92 for controlling the irrigating area of the impingement sprinkler. The reversing device 94 includes a poke rod 95 downward extending therefrom and two limit rods 96 horizontally pivotally mounted on the tubular structure 91, wherein an angle is formed between the two limit rods 96 and the angle is adjusted when the two limit rods 96 is pivotally moved relative to the tubular structure 91. The poke rod 95 is reciprocally moved within the angle formed by the two limit rods 96 when the sprinkling device 92 and the impinging device 93 are operated. The sprinkling device 92 is reversed when the poke rod 95 touches a corresponding one of the two limit rods 95. Consequently, the sprinkling device 92 has a sector irrigating area that has a central angle equal to the angle formed by the two limit rods 96.

However, the outflow angle of the sprinkling device 92 of the conventional impingement sprinkler is hardly adjusted. With reference to FIG. 9, the free may have a horizontal height over that of the two limit rods 96 when the sprinkling device 92 is upwardly tilted such that the two limit rods 96 lose their limit function to the poke rod 95 and the sprinkling device 92 does not be reciprocally operated. On the contrary, the free end of the poke rod 95 may be engaged to the tubular structure 91 and the sprinkling device 92 does not be smoothly steered when the sprinkling device 92 is downwardly tilted.

The present invention has arisen to mitigate and/or obviate the disadvantages of the conventional impingement sprinkler in accordance with the prior art.

BRIEF SUMMARY OF THE INVENTION

The main objective of the present invention is to provide an improved impingement sprinkler which is used to absolutely limit the poke rod between two limit rods so as to enable steering of the impingement sprinkler.

To achieve the objective, the impingement sprinkler in accordance with the present invention comprises a main frame and a tubular structure rotatably mounted onto a lower portion of the main frame, wherein the tubular structure is adapted to be securely connected to an upright pipe. Two limit rods is horizontally pivotally mounted on the tubular structure, wherein an angle is formed between the two limit rods and the angle is adjusted when the two limit rods is pivotally moved relative to the tubular structure. A sprinkling device is laterally mounted onto the main frame. An impinging device is pivotally mounted on the sprinkling device, wherein the impinging device continually impinges the sprinkling device for intermittently rotating the main frame relative to the tubular structure when the sprinkling device continually sprinkles and the sprinkled water continually forces on the impinging device. A trigger is connected to the reversing device. The trigger is formed with a head and a poke rod is pivotally connected to the head, wherein the poke rod is selectively swung relative to the head to make the poke rod absolutely extending over the two limit rods.

The trigger is reciprocally moved within the angle formed by the two limit rods when the sprinkling device and the impinging device are operated, and the sprinkling device is reversed when the trigger touches a corresponding one of the two limit rods such that the sprinkling device has a sector irrigating area that has a central angle equal to the angle formed by the two limit rods.

Further benefits and advantages of the present invention will become apparent after a careful reading of the detailed description with appropriate reference to the accompanying drawings.

DETAILED DESCRIPTION OF THE INVENTION

Figure 1:
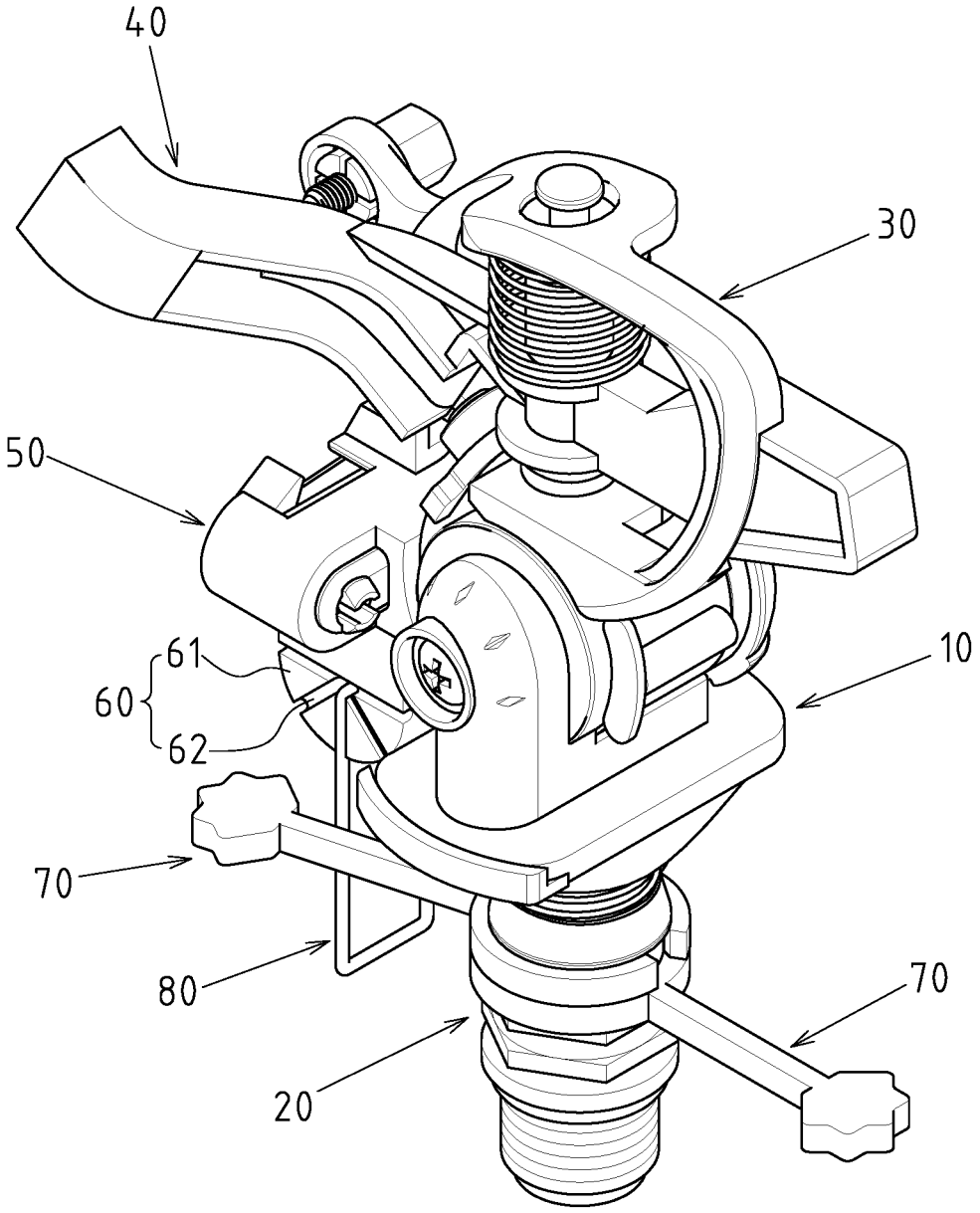
FIG. 1 is a perspective view of the impingement sprinkler in accordance with the present invention.
Figure 2:
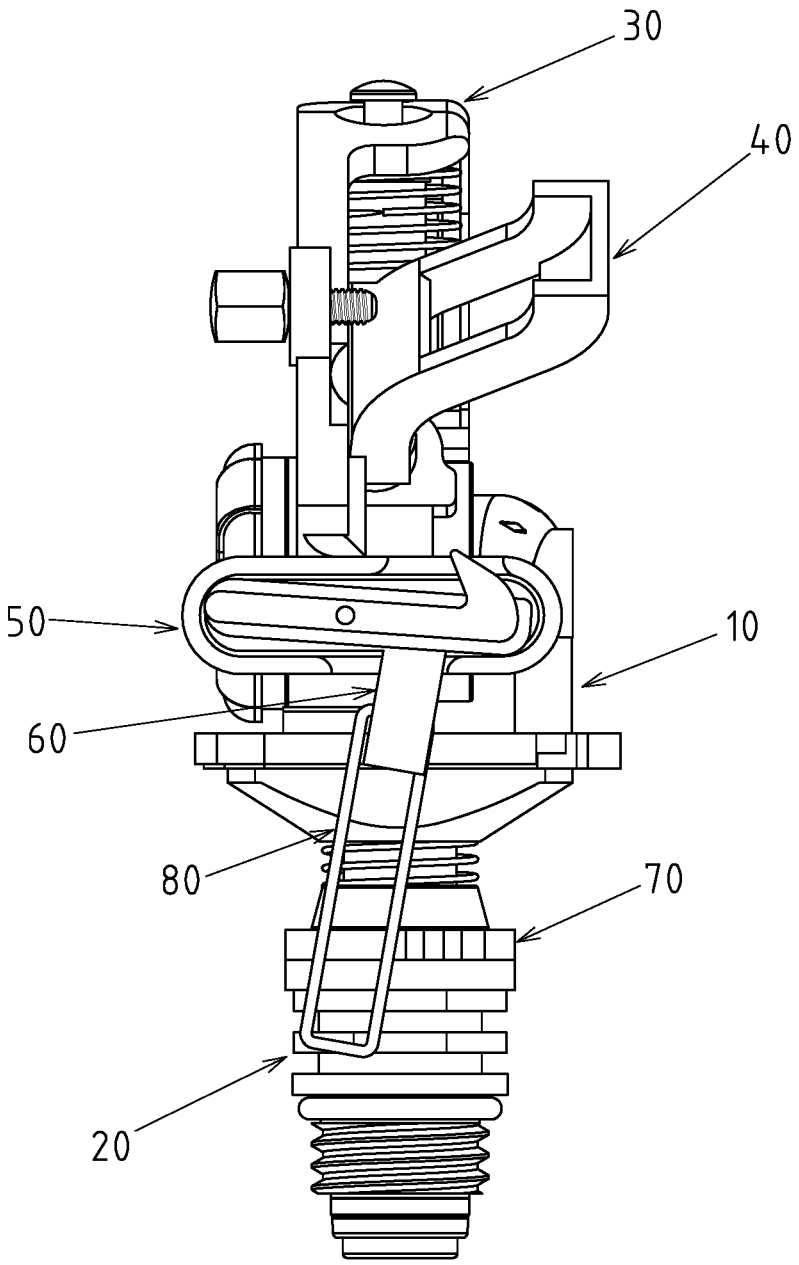
FIG. 2 is a front plan view of the impingement sprinkler in FIG. 1.

Referring to the drawings and initially to FIGS. 1-4, an impingement sprinkler in accordance with the present invention comprises a main frame 10 and a tubular structure 20 rotatably mounted onto a lower portion of the main frame 10, wherein the tubular structure 20 is adapted to be securely connected to an upright pipe (not shown). A sprinkling device 30 is laterally mounted onto the main frame 10 and an impinging device 40 is pivotally mounted on the sprinkling device 30. The impinging device 10 continually impinges the sprinkling device 30 for intermittently rotating the main frame 10 relative to the tubular structure 20 when the sprinkling device 30 continually sprinkles and the sprinkled water continually forces on the impinging device 40.

A reversing device 50 is mounted onto the sprinkling device 30 for controlling the irrigating area of the impingement sprinkler. A trigger 60 is connected to the reversing device 50 and two limit rods 70 horizontally pivotally mounted on the tubular structure 20, wherein an angle is formed between the two limit rods 70 and the angle is adjusted when the two limit rods 70 is pivotally moved relative to the tubular structure 20. The trigger 60 downward extends over the two limit rods 70. The trigger 60 is reciprocally moved within the angle formed by the two limit rods 70 when the sprinkling device 30 and the impinging device 40 are operated. The sprinkling device 30 is reversed when the trigger 60 touches a corresponding one of the two limit rods 70. Consequently, the sprinkling device 30 has a sector irrigating area that has a central angle equal to the angle formed by the two limit rods 70.

The trigger 60 is formed with a head 61 having a semi-circle shape and a poke rod 80 pivotally connected to a center of the head 61, wherein the poke rod 80 is selectively swung relative to the head 61 to make the poke rod 80 absolutely extending over the two limit rods 70. The head 61 has a series of grooves 62 radially defined therein and the poke rod 80 is selectively engaged to a corresponding one of the series of grooves 62 due to a tilted angle of the sprinkling device 30.

Figure 3:
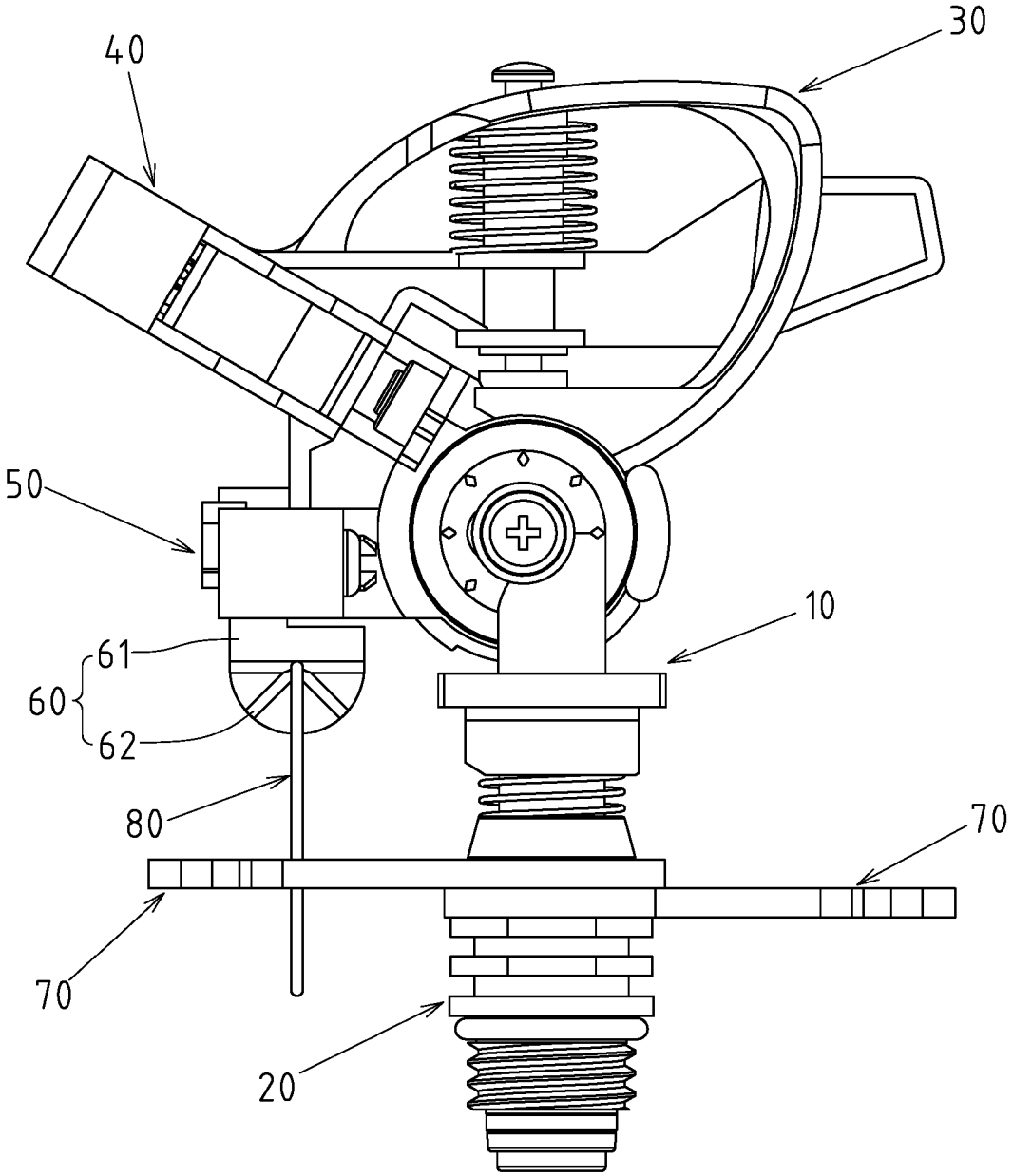
FIG. 3 is a side plan view of the impingement sprinkler in FIG. 1.
Figure 4:
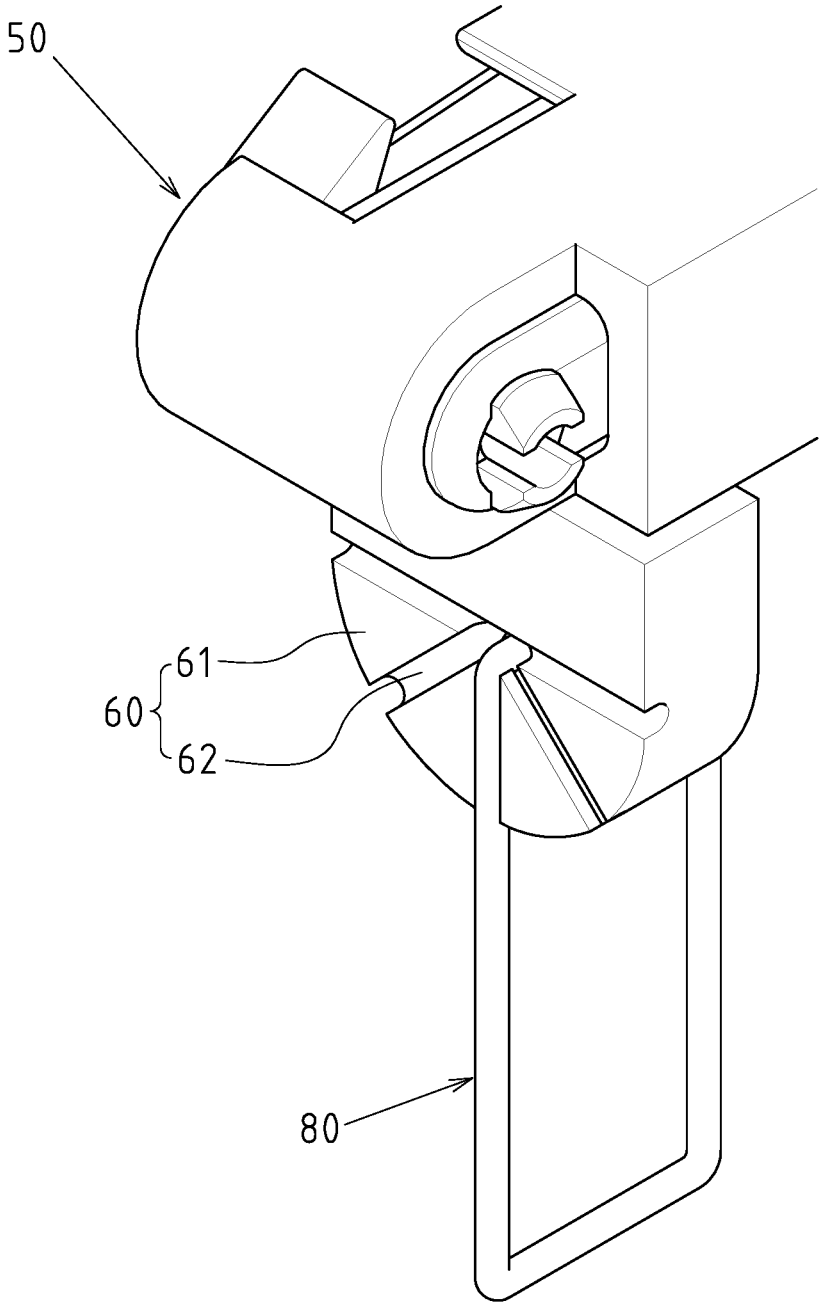
FIG. 4 is a perspective view of a head and the poke rod of the impingement sprinkler in accordance with the preset invention.
Figure 5:
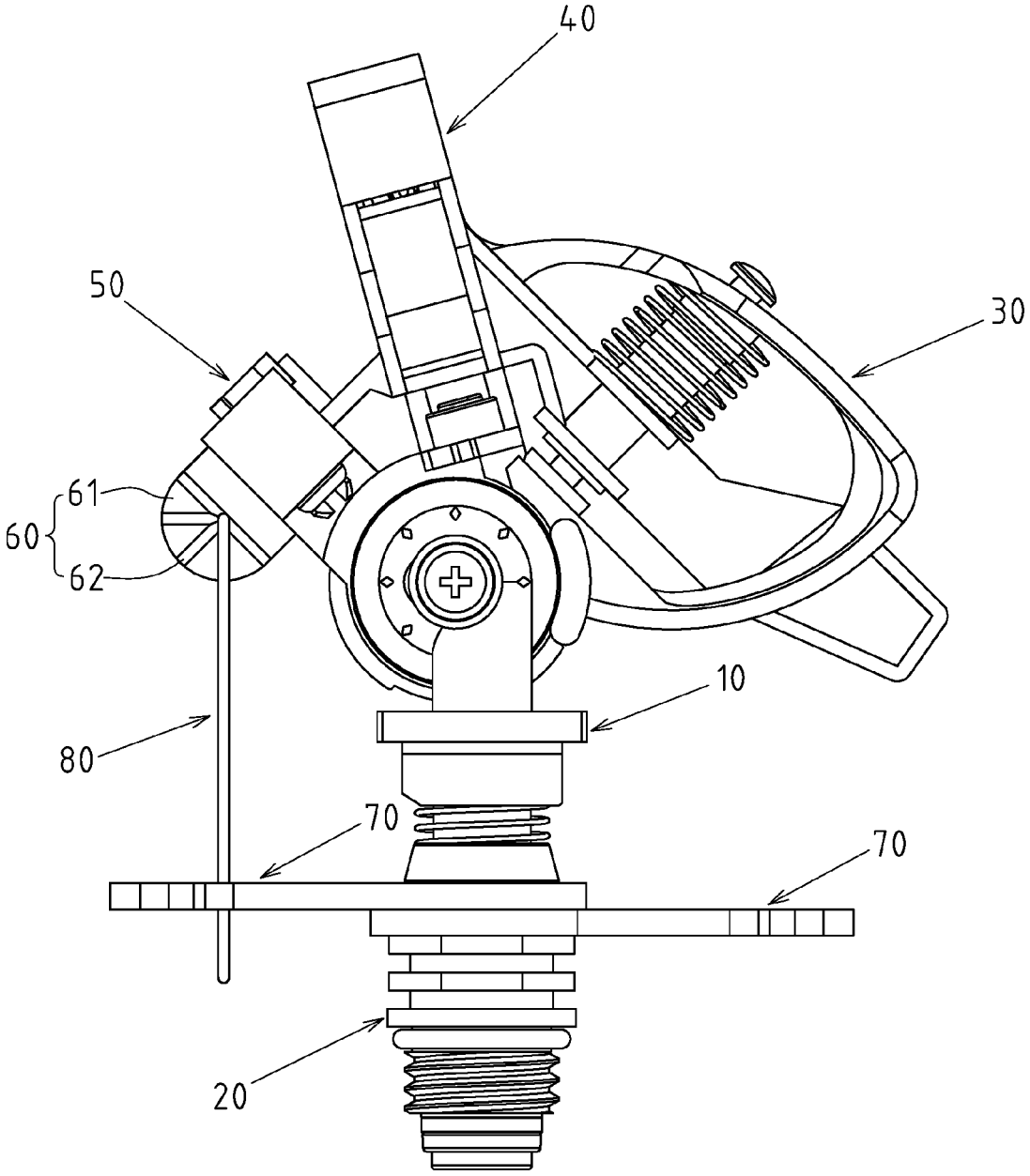
FIG. 5 is an operational view of the impingement sprinkler when the sprinkling device, the trigger rod are upward tilted and the poke rod is moved toward the tubular structure.
Figure 6:
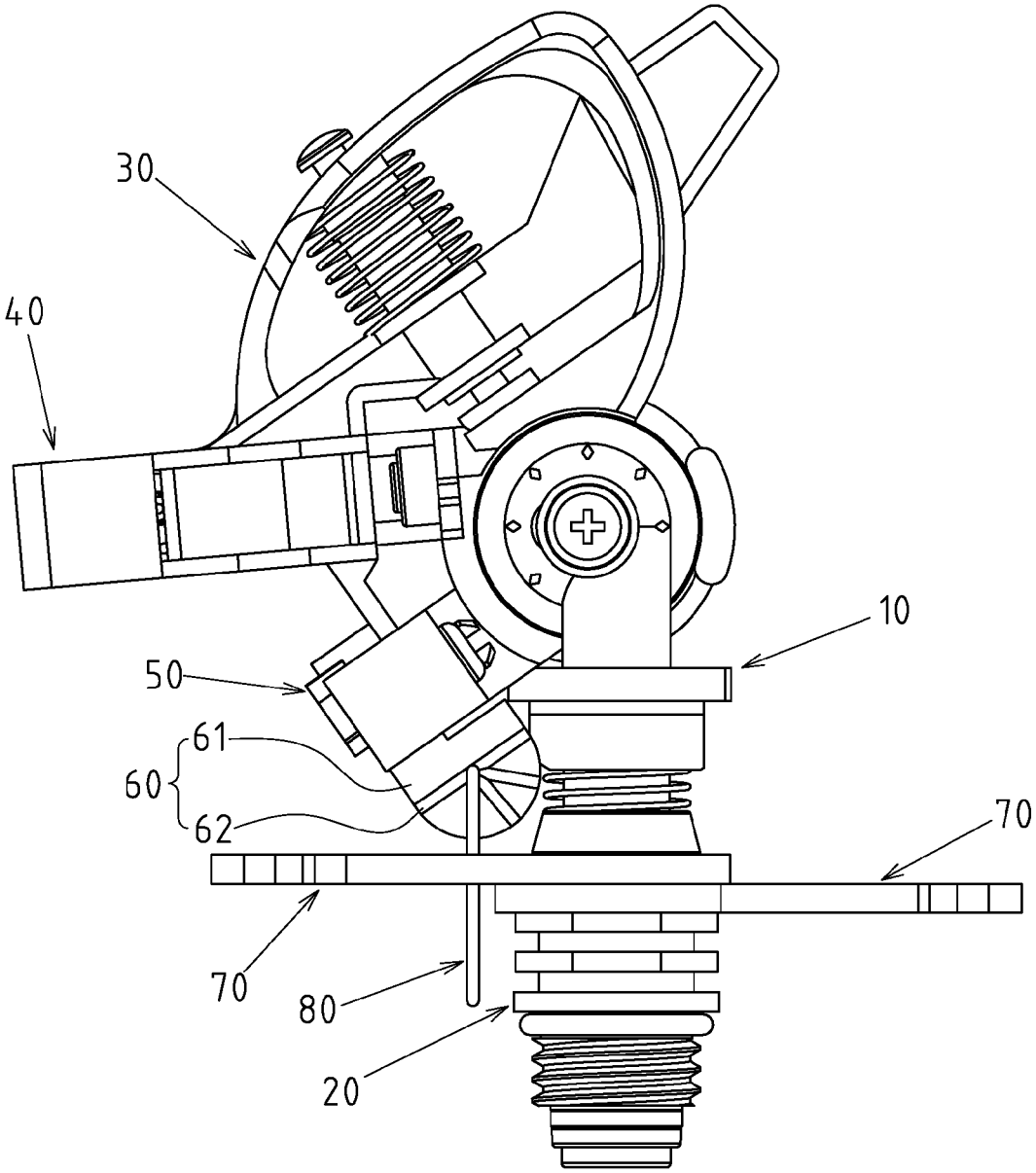
FIG. 6 is an operational view of the impingement sprinkler when the sprinkling device, the trigger rod are downward tilted and the poke rod is outwardly moved relative to the tubular structure.
Figure 7:
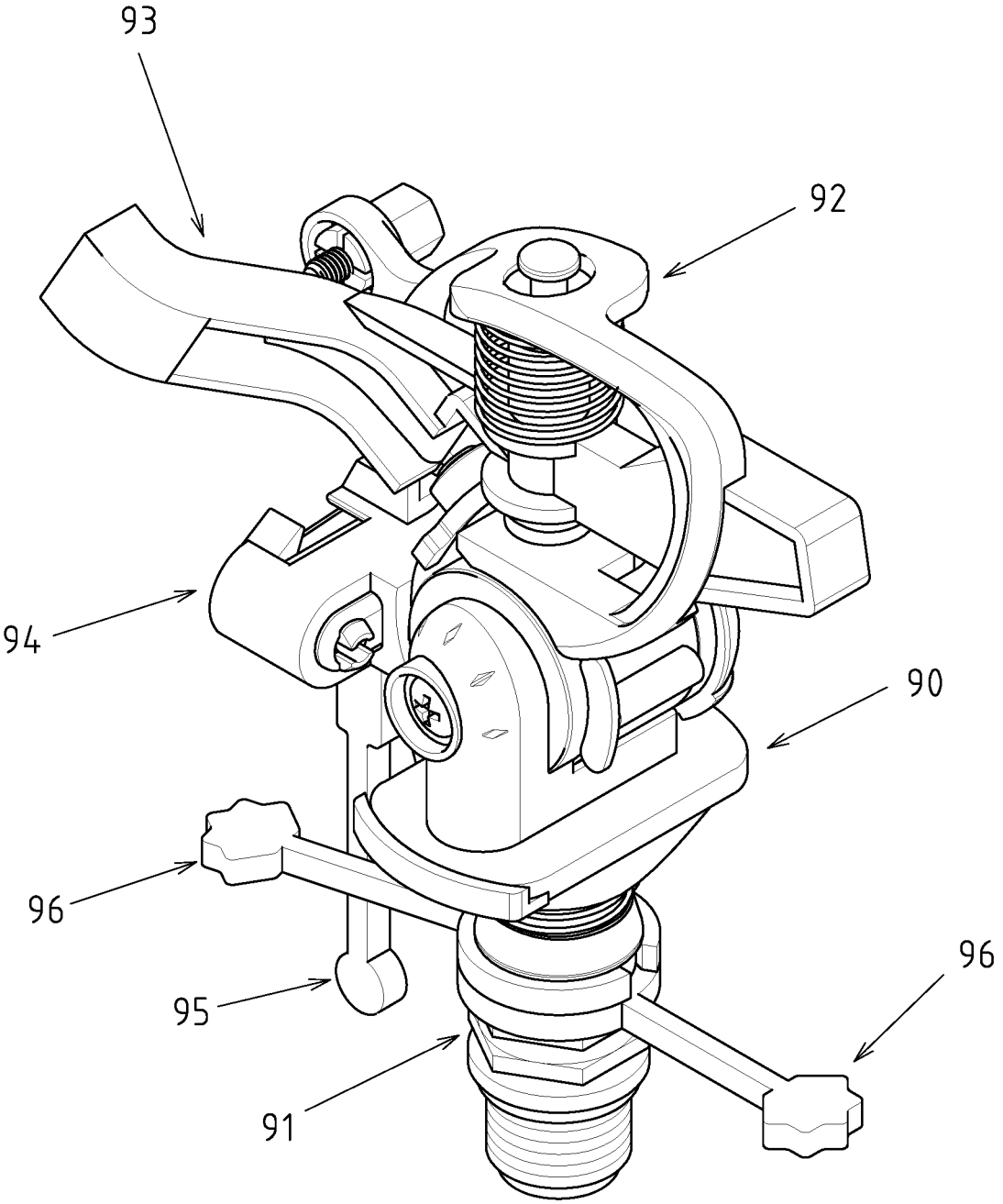
FIG.7 PRIOR ART
FIG. 7 is a perspective view of a conventional impingement sprinkler in accordance with the prior art.
Figure 8:
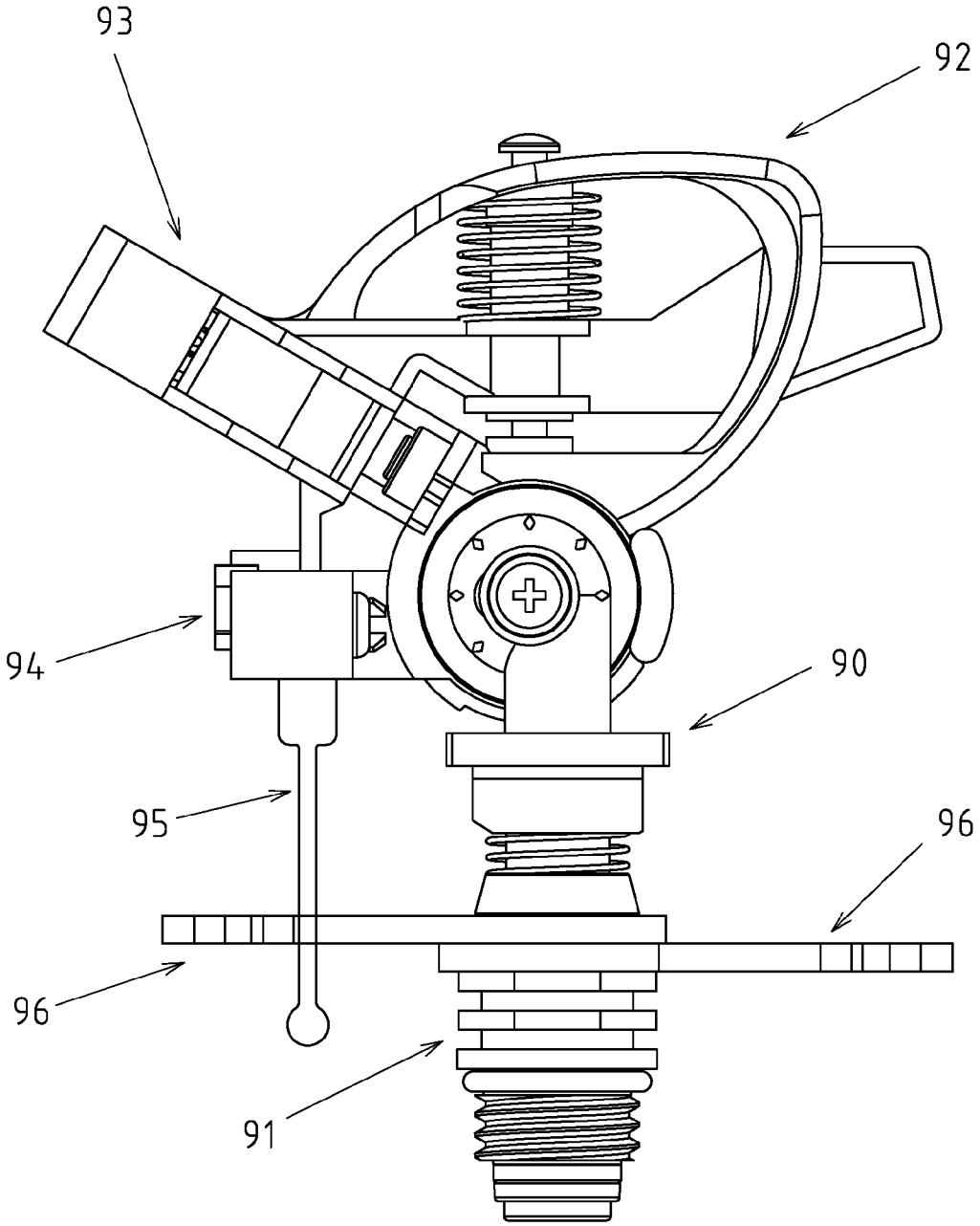
FIG.8 PRIOR ART
FIG. 8 is a side plan view of the conventional impingement sprinkler in FIG. 7.
Figure 9:
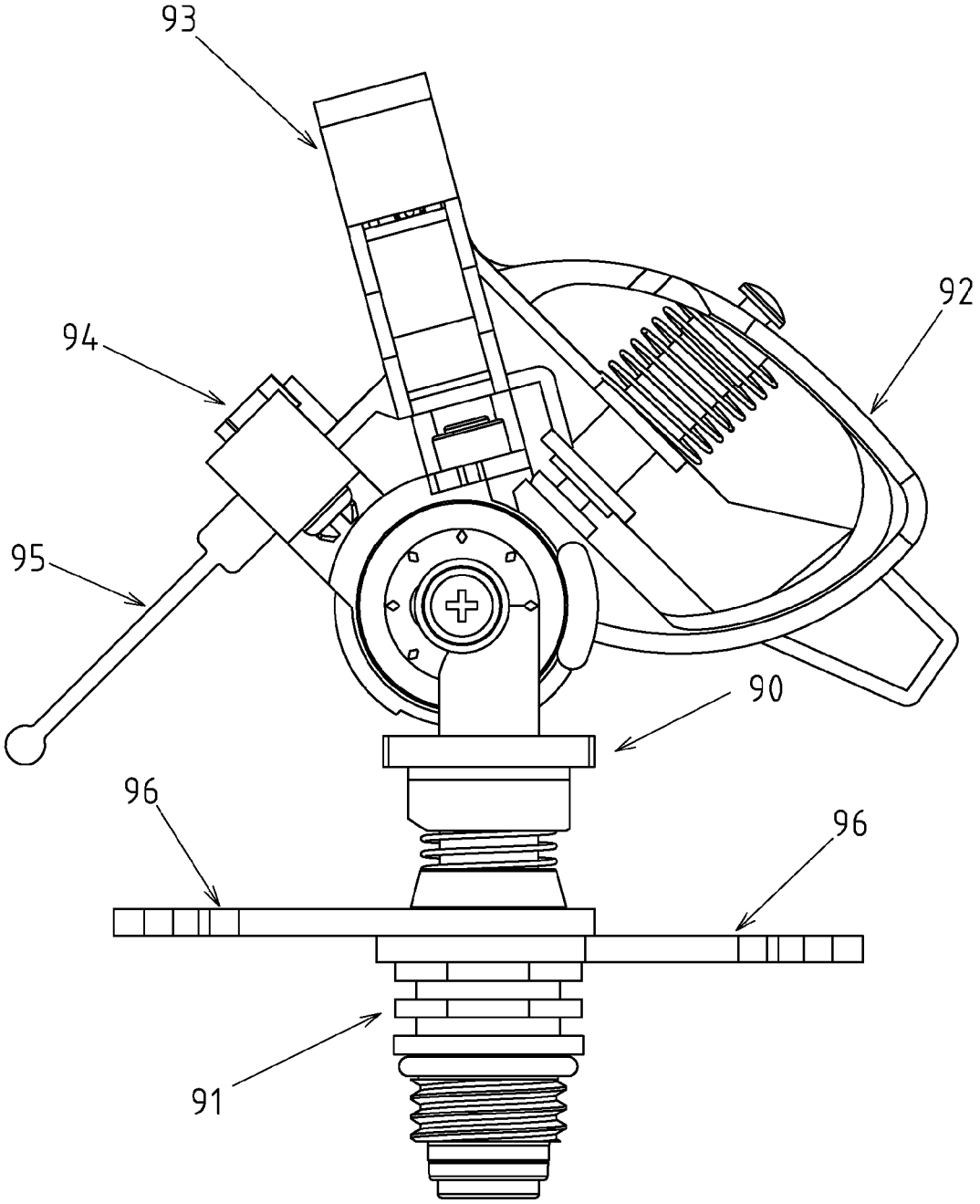
FIG.9 PRIOR ART
FIG. 9 is a side plan view of the conventional impingement sprinkler in FIG. 7 when losing the reversing function.

With reference to FIG. 3, in an original status, the poke rod 80 linearly corresponds to the trigger 60. With reference to FIG. 5, the poke rod 80 is moved toward the tubular structure 20 and engaged into a corresponding one of the series of grooves 62 for reducing a height of the free end of the poke rod 80 and absolutely limited between two limit rods 70 when the sprinkling device 30 is upwardly tilted for adjusting the outflow angle and the free end of the poke rod 80 has a horizontal height over that of the two limit rods 70. With reference to FIG. 6, the poke rod 80 is outwardly moved relative to the tubular structure 20 and engaged into a corresponding one of the series of grooves 62 for making the free end of the poke rod 80 disengaged to the tubular structure 20 when the sprinkling device 30 is downward tilted for adjusting the outflow angle. As described above, the poke rod 80 is absolutely limited between two limit rods 70 so as to enable steering of the impingement sprinkler.

Although the invention has been explained in relation to its preferred embodiment, it is to be understood that many other possible modifications and variations can be made without departing from the spirit and scope of the invention as hereinafter claimed.

I claim:

1. An impingement sprinkler comprising:

a main frame;

a tubular structure rotatably mounted onto a lower portion of said main frame, wherein the tubular structure is adapted to be securely connected to an upright pipe;

two limit rods horizontally pivotally mounted on said tubular structure, wherein an angle is formed between said two limit rods and the angle is adjusted when said two limit rods are pivotally moved relative to the tubular structure;

a sprinkling device laterally mounted onto said main frame;

an impinging device pivotally mounted on said sprinkling device, wherein the impinging device continually impinges said sprinkling device for intermittently rotating said main frame relative to said tubular structure when said sprinkling device continually sprinkles water and the sprinkled water continually forces on said impinging device;

a trigger formed with a head and a poke rod pivotally connected to the head, wherein the poke rod is selectively swung relative to the head so as to make the poke rod extend entirely over the two limit rods;

wherein said trigger is reciprocally moved within the angle formed by said two limit rods when said sprinkling device and said impinging device are operated, and said sprinkling device is reversed when said trigger touches a corresponding one of said two limit rods such that said sprinkling device has a sector irrigating area that has a central angle equal to the angle formed by said two limit rods, wherein the head has a semi-circular shape and a series of grooves radially defined therein, and the poke rod is selectively engaged to a corresponding one of the series of grooves due to a tilted angle of said sprinkling device.

* * * * *